US011040816B2

(12) United States Patent
Hirsch et al.

(10) Patent No.: US 11,040,816 B2
(45) Date of Patent: Jun. 22, 2021

(54) INSULATED PORTABLE STEAM SOURCE

(71) Applicants: Aryeh Hirsch, Valley Village, CA (US); Moshe Hirsch, Valley Village, CA (US)

(72) Inventors: Aryeh Hirsch, Valley Village, CA (US); Moshe Hirsch, Valley Village, CA (US)

( * ) Notice: Subject to any disclaimer, the term of this patent is extended or adjusted under 35 U.S.C. 154(b) by 153 days.

(21) Appl. No.: 16/416,067

(22) Filed: May 17, 2019

(65) Prior Publication Data

US 2020/0361689 A1 Nov. 19, 2020

(51) Int. Cl.

| | |
|---|---|
| ***D06B 1/08*** | (2006.01) |
| ***B65D 81/18*** | (2006.01) |
| ***F24V 30/00*** | (2018.01) |
| ***A45C 3/00*** | (2006.01) |
| ***B65D 81/38*** | (2006.01) |

(52) U.S. Cl.

CPC ..... *B65D 81/18* (2013.01); *A45C 3/004* (2013.01); *B65D 81/38* (2013.01); *D06B 1/08* (2013.01); *F24V 30/00* (2018.05)

(58) Field of Classification Search

CPC ..... B65D 81/18; B65D 81/38; F24V 30/00; A45C 3/004; D06B 1/08

USPC ..... 68/5 R

See application file for complete search history.

(56) References Cited

U.S. PATENT DOCUMENTS

| | | | | |
|---|---|---|---|---|
| 5,605,144 | A * | 2/1997 | Simmons | A41D 13/0051 126/204 |
| 7,708,009 | B1 * | 5/2010 | Collins | F28D 20/028 126/204 |
| 2004/0178384 | A1 * | 9/2004 | Usui | A61F 7/034 252/76 |
| 2008/0200971 | A1 * | 8/2008 | Dodo | F24V 30/00 607/108 |
| 2008/0251062 | A1 * | 10/2008 | Dodo | C09K 5/18 126/263.02 |
| 2012/0145189 | A1 * | 6/2012 | Knopow | F24V 30/00 134/6 |

OTHER PUBLICATIONS

KR20000040103A—Machine translation (Year: 2000).*

* cited by examiner

*Primary Examiner* — Tinsae B Ayalew
(74) *Attorney, Agent, or Firm* — Nelson Patent Law

(57) ABSTRACT

A flameless and nonelectric insulated steam source. The steam source may be operated within a garment bag to refresh and remove wrinkles from an article of clothing. Hydrating an exothermic compound produces steam. An insulator within the steam source allows the pouch to be handled and prevents damage to the garment bag and the surroundings when using compounds with high thermal output. Single-use garment bags employ integrated steam sources to streamline garment steaming. A garment bag can be designed to optimize the benefit to garments when using the steam source.

13 Claims, 5 Drawing Sheets

INSULATED PORTABLE STEAM SOURCE

FIELD OF INVENTION

The present invention relates to apparatus for refreshing articles of clothing, and more particularly to an apparatus using an exothermic compound to generate steam.

BACKGROUND AND RELATED ART

During travel, clothing may become wrinkled and pick up malodors. If such a trip is for business purposes, having clothing in such a state is seen as unprofessional; similarly, a vacation may be negatively affected by having clothing in an unsatisfactory state. It is desirable to have a quick and convenient means to remove wrinkles and refresh garments. Ironing boards may not be available in every lodging accommodation. Further, ironing can be an inconvenient task during a busy trip. Commercial drycleaning can take hours or even days, and involve inconvenient travels to drop off and pick up the clothing.

Many attempts at producing a portable and convenient means for steaming clothing have focused on plug-in or battery-powered devices that produce steam using a heating element. Such devices have bulky form factors and present difficulties in travel. Further the heating element in these devices poses a safety concern, and for this reason such devices are banned on most cruise ships.

Previous efforts have attempted to solve this problem using other exothermic compounds. For example, South Korean patent application publication KR20000040103A discloses a portable non-electric iron that uses an exothermic compound to provide heat. While functional, this design may prove heavier and less portable than desirable, particularly with its use of a metal plate. Similarly, U.S. patent application Ser. No. 13/313,834 filed in 2011 discloses a portable self-heating steam generating pad which, when attached to a handle, can be used for ironing clothes or mopping floors.

U.S. Pat. No. 7,749,401 issued in 2010 to Roselle et al. describes an iron-based compound that produces steam upon contact with water—the steam generated is applied to clothing within an enclosure. While this solution addresses many of the problems relating to portability, it can unfortunately result in compromises between the performance of the exothermic heating and the safety of the application.

The heating potential of exothermic compounds is well recognized. Exothermic compounds have been widely used to heat food without fire or electricity. U.S. Pat. No. 9,435,567 issued in 2016 to Ra et al. describes a heating container for cooking food via a high-temperature exothermic reaction.

SUMMARY OF INVENTION

The present invention addresses many of the problems by providing a convenient, low cost and relatively safe heat generating pouch that can be used to safely freshen and remove wrinkles from clothing within garment bags and other enclosures. The pouch described herein provides an insulating layer which allows the employment of high-heat generating exothermic compounds in creating steam for freshening clothing without necessarily creating the risks of injury or damage to the operator or adjacent surfaces. The pouch is provided in a light weight, and low cost package that can be disposed of after its use.

DETAILED DESCRIPTION

The following sections describe, by example, the present invention in operation and composition, followed by manufacturing details and related considerations.

In Operation

Figure 1:
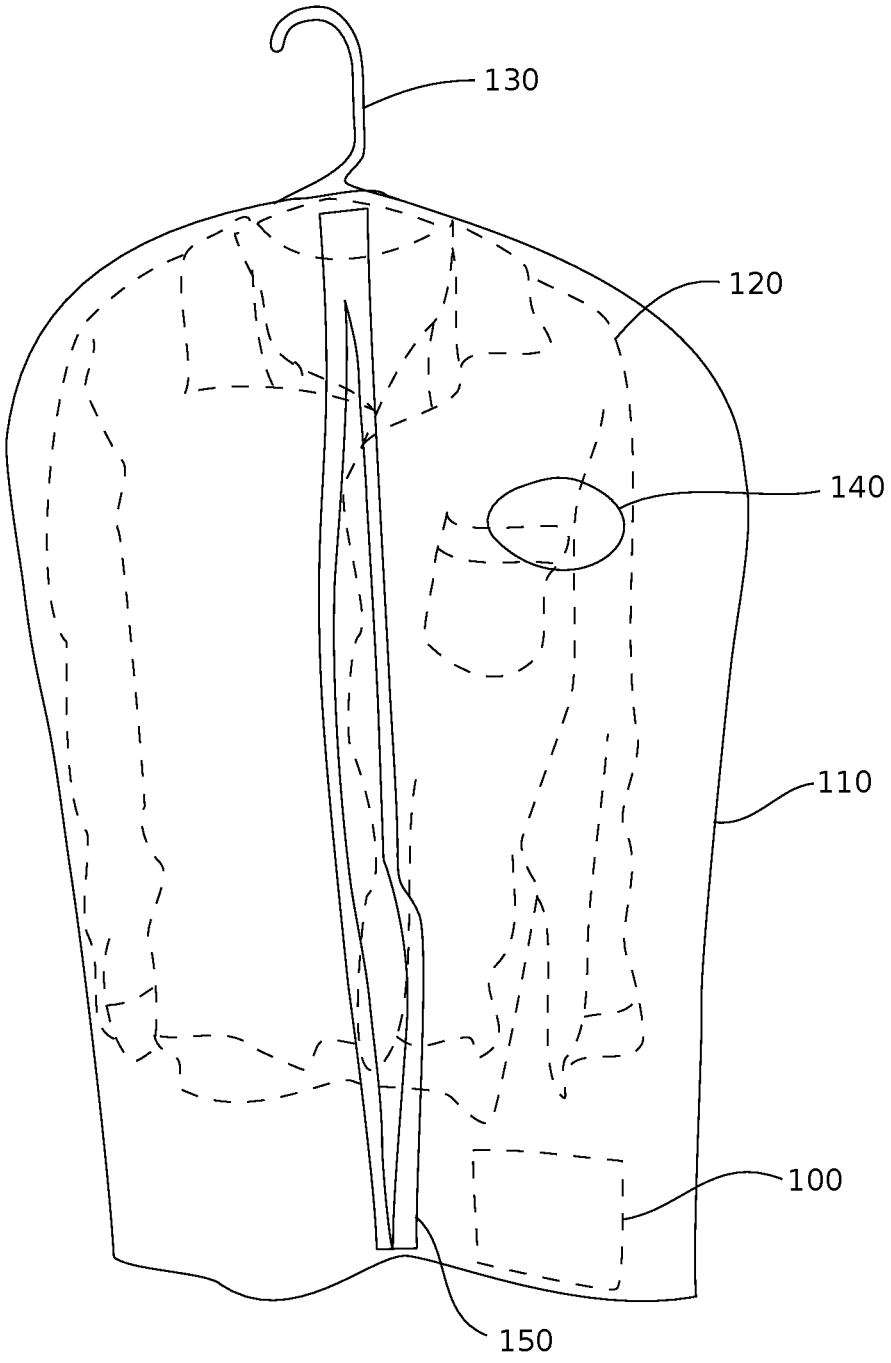
FIG. 1 is a front view of a pouch in use within a typical garment bag.
Figure 2:
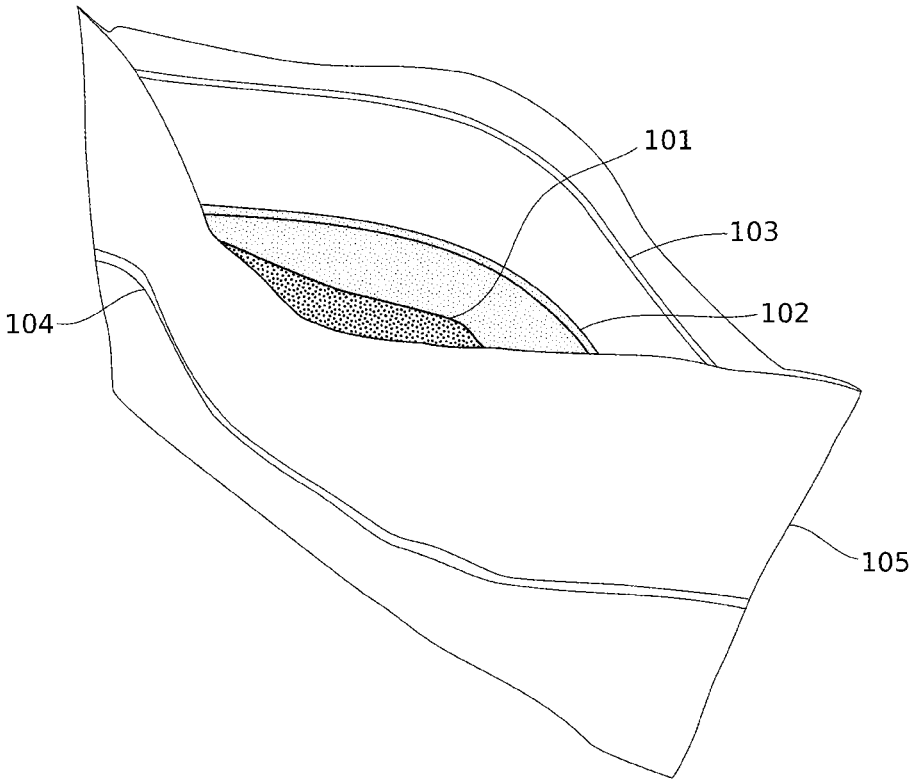
FIG. 2 is a perspective view of an open pouch, displaying exterior and interior components.
Figure 3:
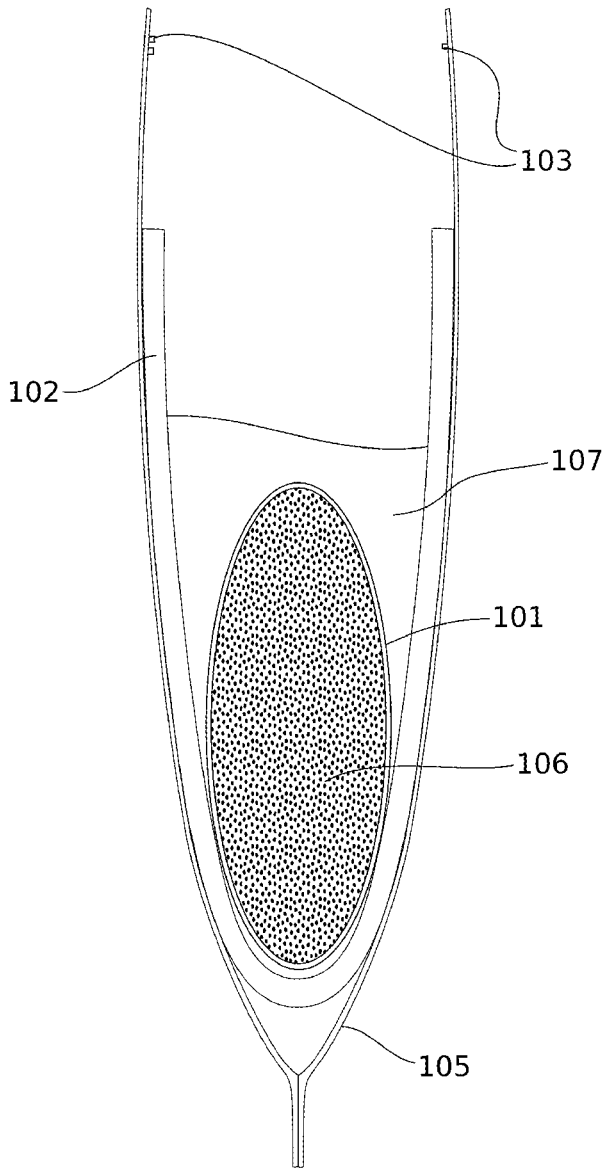
FIG. 3 is a sectional view of pouch in FIG. 2 with water covering the packet.

FIG. 1 shows a configuration for a typical use of one embodiment of the present invention. In this example, a shirt (or one or more other articles of clothing) 120 is first suspended upright from a hanger 130 within a typical garment bag (or closet or other garment holder) 110. The heating pouch 100 is prepared for use by tearing across the top of the pouch 100, which exposes a packet 101 which is largely surrounded by a water impermeable and temperature insulating material 102 as can be seen in FIGS. 2 and 3. Water 107 is poured into the pouch 100 through an input port (which is typically the opening at the top of the pouch) and onto the packet through an opening in the insulation 102 so that much of the water 107 is absorbed by the packet 101 within a heating chamber defined by the insulation. The pouch 100 is then placed upright at the bottom of the garment holder 110. The pouch 100 begins to emit steam within approximately 15 seconds. After the pouch 100 has been placed in the garment holder 110, the garment holder is mostly closed to retain steam that has been produced and to allow moisture and heat to penetrate the fabric of the clothing 120, removing wrinkles. Depending on the fabric and condition of the clothing, the process of steaming to remove wrinkles may take more than 5 minutes. A transparent window 140 built into the garment bag 110 may be used to inspect the clothing without releasing the heat and steam. Once the treatment of the clothing has completed, the user removes the used pouch 100 from the garment bag and pours out any water 107 remaining in the pouch 100, which can then be thrown away.

Throughout this process, the insulation 102 enables the pouch to be handled during use. When hydrated, exothermic compounds 106 reach boiling temperatures relatively quickly. The insulation 102 thus simplifies use of the pouch, as it allows the user to move the pouch into the desired location after hydrating the compound and starting the reaction without burning hands. The insulation 102 also protects the garment bag 110 or other enclosure from being burned or otherwise damaged by intense heat. Many garment bags are constructed out of very thin layers of plastic. By providing an insulating layer 102, the heating pouch 100 can operate within typical garment bags while reducing the risk of melting or otherwise damaging the garment bag or persons/things in close proximity. Because the pouch 100 directs the heat and vapor in the same general direction, the insulation layer mitigates risk of the heating pouch becoming an ignition source, as any significant heat that could come in contact with surroundings would be accompanied by water.

Figure 4:
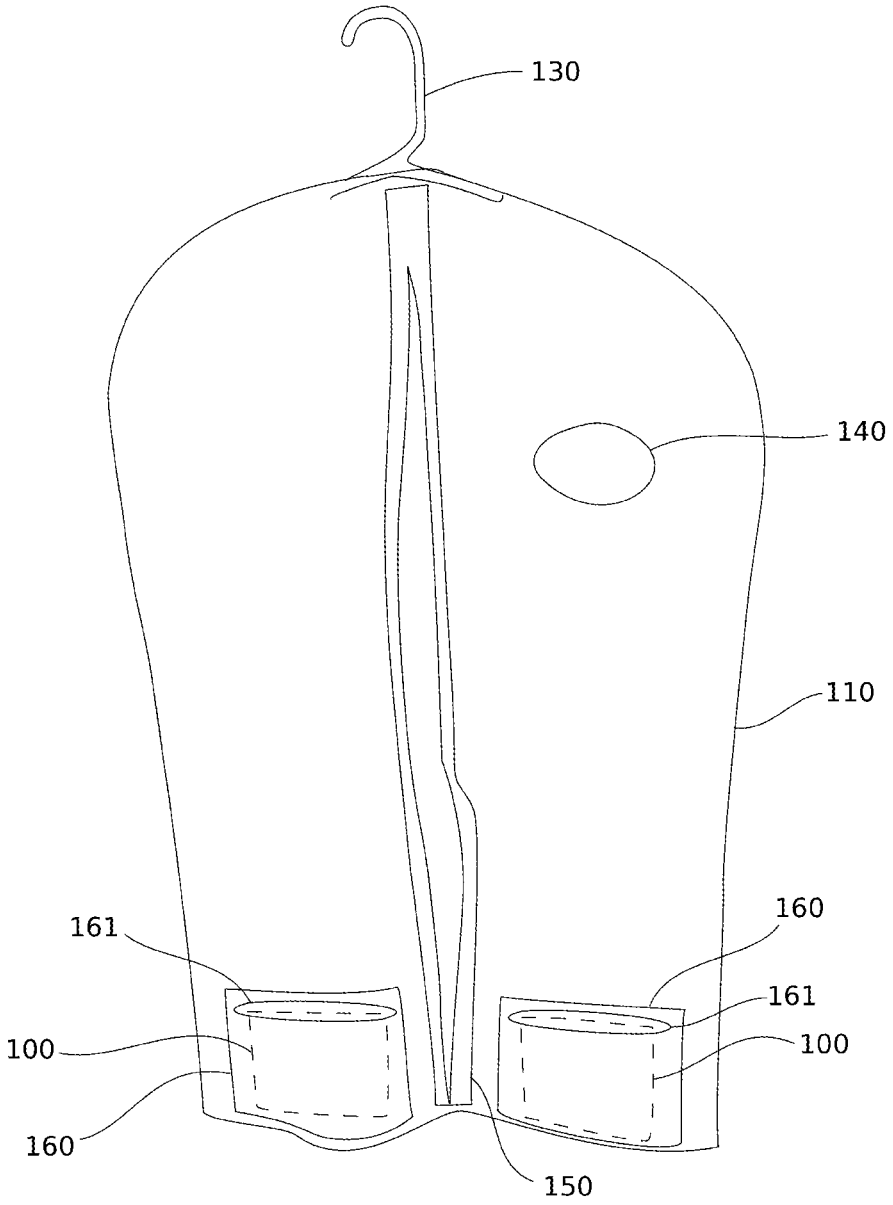
FIG. 4 is a front view of a garment bag with pockets to receive heating pouch.

In other embodiments, such as the example shown in FIG. 4, one or more articles of clothing may be enclosed within a garment bag that has been constructed with one or more built-in compartments 160 for holding the heating pouch. These compartments can be as simple as pockets accessible from the inside of the garment bag. Alternatively, the pockets 160 can be accessed from the outside via slits 161 or some other opening that allows the heating pouch to be inserted and removed without requiring the use of the larger typical garment bag opening 150. A flap could cover the slits to prevent the escape of heat and steam during operation or the slits could be closed via a snap, button, zipper or other closing mechanism.

These alternative ways of accessing the interior of the garment bag 110 can prove especially useful in cases where stubborn wrinkles, for example, require two or more heating packets to be used sequentially.

In some use cases, one or more of the garment bag's openings may be left open to allow the release of steam and odors from the garment. Additives may also be included within the garment bag or enclosure to provide additional benefits, such as fragrances, scent neutralizers and other "benefit agents" such as have been described in related art. These may be applied independently or included as part of the pouch. In an example unique to the present invention, a temperature and moisture sensitive benefit agent might be placed within the pouch between the insulative layer 102 and the exterior layer 105, enabling a more careful application of heat and moisture than if the agent were enclosed directly within the packet 101.

In some self-contained embodiments, the water or fluid may be contained within a reservoir that has been integrated into or connected to the pouch 100. In such uses, the user can start the exothermic reaction by performing an action to release the fluid into the heating chamber. While these embodiments may require more space for the fluid volume, they can provide additional convenience and may make it easier for users to apply the correct amount of fluid 107.

Details of Composition

The garment enclosure 110 discussed herein may be a garment bag or another enclosure such as a small closet. Preferably, the enclosure would be water resistant and not subject to damage from heat or moisture. Certain plastics may be ideal. Nonetheless, many leather garment bags and closets with wood materials may work as well for infrequent and short-term use. Preferably, the enclosure would be small enough to allow the heat and steam generated by the small pouch 100 to completely fill the enclosure and treat the clothing 120 within. A window or viewport 140 may be provided to enable identification and inspection of the clothing before, during or after treatment. A typical garment bag 110 will include a large opening 150 for inserting and removing clothing. This opening is often closed with a zipper or another fastener and can also be used to insert or remove the pouch 100 described herein.

In a preferred embodiment, the exothermic compound 106 is comprised of calcium oxide (CaO) powder, also known as quicklime or burnt lime. In reacting with water, quicklime is known to produce enough heat to ignite combustible materials. The exothermic compound may also include sodium bicarbonate. Preferably, the exothermic compound is enclosed within a material that both prevents its escape and permits fluid to reach the compound, initiating the chemical reaction. It is desirable to enclose the exothermic compound in a fluid-permeable material 101 that reduces the likelihood of spillage and accidental skin contact with the exothermic compound after the package is opened. It is beneficial for this barrier layer of the packet 101 to be able to withstand both the heat created by the chemical reaction and the increase in volume that results from the reaction. The barrier made of heat resistant cloth can work well for this temperature range and small packets of exothermic compounds 106 may be shipped from a vendor packaged within an appropriate barrier layer 101. One advantage of using quicklime as an exothermic compound is that steam is a product of the reaction. The heat and water vapor produced may be ideal for removing wrinkles from clothing.

As is known in the art, other exothermic compounds may also be used. For example, iron, carbon and metal salt have been mixed with water and oxygen to create heat in other applications. Water is an ideal component to start a reaction as it is readily available and can easily be carried separately, then mixed only when desired. For the purpose of this invention, describing an exothermic compound including water and oxygen should be considered equivalent (in use) to naming the components that are contained within the heating packet 101. In selecting a compound, it is important to ensure that the product of the reaction does not cause undesired stains or odors to attach to the clothing. Further, for this application, it is important that the reaction cause no damage to the clothing such as might be caused by an acidic or caustic byproduct escaping the pouch. This leaves a number of compounds that provide acceptable performance. Many, among these, are consistent with the teachings of this invention.

The insulative layer 102 significantly improves the safety of handling the exothermic compound and using the compound to treat clothing. While this layer can take many forms, an objective is broadly to shield the user and nearby objects from exposure to damaging or uncomfortable levels of heat produced by the exothermic compound in the heating chamber. Studies suggest that temperatures as low as 111 degrees fahrenheit can be uncomfortably hot, when the skin on hands are exposed for more than 10 seconds. First degree burns can occur at 118 degrees and human skin can be destroyed at 162 degrees. Acrylics can melt at 196 degrees and dried wood can ignite at just over 300 degrees. With a quicklime water reaction reaching around 300 degrees, an effective insulative layer must maintain safe temperatures for the duration of the reaction.

The insulative layer 102 can also function to prevent the loss of heat in directions that do not benefit the treatment of the clothing. By focusing the heat loss from the package in the heating chamber to the clothing to be treated, the insulation can enable a heating packet to perform better than it would without insulation.

Preferably, the insulation layer 102 would be thin, allowing for compact storage. Compact storage can enable a traveler to pack several pouches within their luggage and travel for extended periods of time without the weight or bulk of an iron. It is envisioned that a stack of heating pouches could consume only a small portion of space in a bag or suitcase.

FIG. 3 shows a cross section of a pouch consistent with the teachings of this invention. The insulation layer 102 is shown to surround the packet and fluid 107 but for an opening at the top where heated vapor escapes. This enclosure is referred to as a heating chamber. Preferably, consistent with this example, the insulation layer 102 should be a closed-cell foam. Foams in this class have desirable sealing properties which prevent heated water from seeping through the insulator. The insulation may be fixed to the packaging to prevent leakage of water between the insulating layer and the packaging. It is also a goal to provide a semi-translucent insulation layer, so that a 'fill line' 104 defined on the exterior 105 of the packaging may be used.

Polyethylene foam possesses properties that can make it ideal for use as an insulator 102 in the example shown in FIGS. 2 and 3. Polyethylene foam is durable, lightweight, closed-cell, odorless, flexible and resistant to water. It is also very easy to fabricate, can be made translucent and has excellent thermal insulation properties. Flexibility can be beneficial because quicklime increases in volume (more than 2×) as it interacts with water. Flexible insulation would enable the pouch to be expanded for use. Flexible insulation also allows the pouch to deform slightly to the environment in which it is placed: for example, the garment bag.

In a preferred embodiment, the insulator 102 is closed cell polyethylene foam approximately one eighth of an inch in thickness and bonded at the edges to form a watertight envelope. This envelope is secured by an adhesive to flat portion of the exterior layer 105 of the pouch, enabling the envelope to be opened when the pouch is opened. In use, this functions to keep the water 107 contained within the insulated portion of the pouch, where the packet containing the exothermic compound 101 is located. The entire pouch 100 can be approximately 6 inches wide, 6 inches deep and 1 inch thick at its thickest point before use. This largely flat form and relatively small overall size enables easy storage.

In other embodiments, alternative insulating materials may be used. For example, corrugated cardboard may be an excellent insulator, preventing the transmission of heat by means of an air gap. Cardboard, however, can absorb moisture, causing the cardboard to lose rigidity, diminishing the air gap (and insulative properties) unless it has been sealed. Like closed cell foam and corrugated cardboard, many other materials use air (or other gases) to provide a gap through which heat is not easily transmitted, provided the gap is maintained. As another example, wool fibers are known to be very resistant to heat damage. A insulating pad containing wool fibers and a gas to separate interior and exterior surfaces might work especially well in reusable applications. To prevent hot fluid from filling the gap and reducing the effectiveness of the insulator, a heat-resistant waterproof membrane can be incorporated into (or used with) the insulator 102. Other insulating materials, such as silicone, do not require a gap or waterproofing and can be made fairly thin. More recently developed materials, such as those based on aerogel, may also be used to provide thin, flexible and very effective insulation.

In some embodiments, a fluid reservoir may be employed to hold an appropriate amount of fluid 107 to activate the exothermic reaction. Such a reservoir would be connected to the heating chamber (defined by the insulative layer 102) through an input port. The input port may be opened, for example, via a valve or by applying pressure to burst a membrane. The reservoir may be internal or external to the pouch 100 and may even be contained within the heating chamber, though separated (until use) from other components 101 by the input port.

More typical applications of the present invention will provide fluid through an input port through the exterior layer 105 of the pouch. In a preferred embodiment, the exterior layer 105 is constructed from a thin layer of plastic or another water impermeable material. This layer can prevent moisture from entering the pouch prior to use and can otherwise help to prevent the pouch contents from escaping or being damaged, especially during storage. Notably, the exterior layer 105 in most embodiments will need to be opened to serve its function. First, in embodiments that do not have an integrated fluid reservoir, an opening (or input port) must be provided to introduce water into the pouch. Later, in operation, at least one output port (or vent) will be required to release the heat and steam from the pouch to treat the clothing. In some embodiments, the input port and output ports will be one and the same, taking the form of a single large opening that can be created at the top of the exterior layer 105 of the pouch. The exterior layer may be cut open for use or may have tabs, notches or other guides defined on it to enable it to be neatly torn open by hand. The exterior layer 105 may be resealable to accommodate a user that changes his or her mind once the pouch has been opened. The resealing function may also enable a higher degree of safety in disposal after use, as additional moisture will be prevented from causing further heating of the exothermic compound. The mechanisms used to reseal the exterior layer may be varied. Zipper-style resealable connectors 103 may be employed at a top opening to the pouch. Compounds that are exothermic on their reaction with water may be triggered by water vapor present in the air. Thus, resealing the packaging would extend the lifespan of the compound after opening by limiting contact with said water vapor. It should be understood that ties, latches, snaps, clips and other mechanisms could also be used to achieve the purposes of resealing the pouch.

In some embodiments, there may be several input and/or output ports. For example, input ports may be defined so that water is introduced into the heating chamber through a flap configured to permit the entry, but not the escape, of the fluid. There may be several output ports provided so as to direct the steam out of the heating chamber and distribute it more evenly throughout the garment bag than could be accomplished via a single output port.

The exterior layer 105 may also provide instructions for use. Depending on the material used for the exterior layer, these instructions may be printed in ink. In some embodiments, one or more fill lines 104 may also be provided, such as the one that appears in FIG. 2. These lines can be used to guide the user to an add an optimal amount of water for the use case. The fill line may take the form of an ink line or a translucent portion of the exterior layer 105 in the context of an opaque background.

In some embodiments, the insulative layer 102 and the exterior layer 105 can be one and the same. For example, a single layer comprising silicone or a thicker plastic may take the form of a container and serve the protective purpose of the exterior and simultaneously function as an insulative layer. Such a container could be resealable and reusable enabling a user to replace just the heat packet, thus reducing waste.

FIG. 4 shows a garment bag 110 constructed for use with said heating pouches 100. Such a garment bag would have interior compartments 160 sized to fit and hold the pouches 100, preventing tipping. Compartments 160 may be placed strategically in order to allow pouches to be deposited to focus steaming on a specific part of a garment to effect wrinkle release at a specific location. There are advantages to placing the compartments toward the bottom of the garment bag, as the heat and steam will tend to rise towards the top. Preferably, the exterior of such a garment bag would contain slits (or other openings) 161 to allow the user to deposit or remove the pouches without opening the main portion of the garment bag 150 and releasing the bulk of the steam. The slits 161 may be covered with flaps to prevent the loss of heat and steam. Such a garment bag may also be constructed to allow the use of a hanger 130 at the top of the bag while mitigating steam lost, by way of flaps which conform around the external portion of the hanger and seal the bag.

Figure 5:
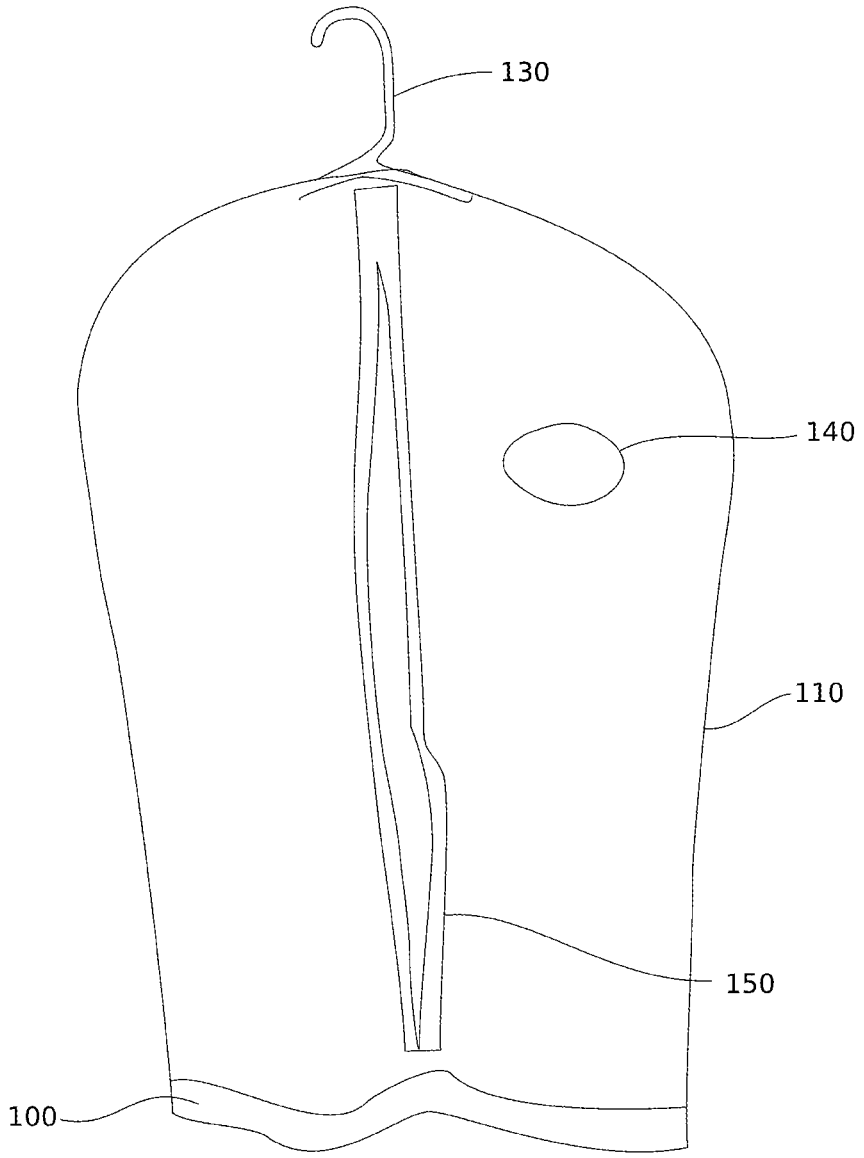
FIG. 5 is a front view of a garment bag with an integrated pouch.

The heating pouch 100 may also be built into a garment bag 110, as shown in FIG. 5. In the example shown, the entire bottom region of the garment bag can be used to hold the insulation 120 and heating packet 101. In such an embodiment, the insulating layer 120 would be fixed to the garment bag 110 (the bag itself serves as the exterior layer 105) and the exothermic compound packet 101 would be contained within the insulation layer. The portion of the garment bag containing the insulation may be sealed (by a thin water resistant film, for example) to protect the compound from outside humidity. To effect steaming, the user might remove said seal to expose the insulation and packet, then add water. A series of holes formed in the inside of the garment bag may serve as the input and output ports, allowing water to reach the exothermic compound and allowing steam and heat to reach the clothing 120. After steaming is complete, the user could dispose of the entire garment bag unit 110. Alternatively, the garment bag may contain a zipper lock around the insulating layer. In this embodiment, the user could reuse the garment bag by removing the used exothermic compound packet and depositing a new one.

It is preferable to be able to print on the exterior layer 105, both to provide aesthetically pleasing packaging and to provide instructions to the user. It is also desirable to provide a 'fill line' 104 by a translucent portion on the exterior package so that the user may deposit a suitable amount of water into the pouch. If the exterior layer is not completely opaque, the fill line 104 may likewise be printed onto the packaging. Thus the chosen ink and exterior material should be suitable for the temperatures reached on the exterior of the insulator.

Manufacturing Considerations

It is well known that the exothermic reaction of calcium oxide and water produces calcium hydroxide. This reaction can be reversed by heating the calcium hydroxide to 512° C. In heating pouches that utilize compounds comprising calcium oxide, it may be possible to reuse the compound, if desired. Otherwise, quicklime and other exothermic compounds are relatively easy and inexpensive to source.

Preferably, the packaging would be cost effective. Foam insulation will likely cost less than many other alternatives. Alternatively, a material may be selected that acts both as insulator and packaging. For example, silicone packaging would provide the desired insulating properties and satisfy the need for effective packaging. In such an embodiment, the silicone exterior may be reused, and a new pack containing the exothermic compound could be deposited with each new use. Closed cell neoprene can serve as a heat insulator, is waterproof and is known to have a burn point of around 500 degrees fahrenheit.

Alternatively, the packaging could comprise biodegradable, recycled or otherwise environmentally friendly materials so as to avoid accumulation in landfills. In some embodiments, the insulation may take the form of corrugated cardboard, for example. In the case of disposable insulation, it should be noted that the insulating effect need only last for the length of time during which the pouch is producing heat. For this reason, it may be acceptable for a single use insulating layer to be destroyed over time while performing its function.

Increasing the number of layers of materials within the pouch is likely to increase the complexity and cost of manufacturing (especially when the pouch is a composition of several different materials). For this reason, it may be desirable to consider materials that can serve a dual purpose, such as the aforementioned foam insulation, which prevents damage/injury from heat while also preventing water from escaping the pouch.

This invention is not to be limited by the embodiments shown in the drawings and described in the description, which are given by way of example, but only in accordance with the scope of the appended claims.

We claim:

1. A heating pouch comprising:
- a heating chamber;
- an exothermic heating compound disposed within said heating chamber;
- an insulating layer separating said heating chamber from at least one surface on the exterior of said heating pouch;
- a water impermeable layer operable to prevent the escape of heated water;
- a protective exterior layer;
- an input port operable to deliver fluid to said heating chamber; and
- at least one output port operable to release a majority portion of heat and vapor from said heating chamber.

2. The heating pouch of claim 1, wherein said input port is resealable.

3. The heating pouch of claim 1, wherein said input port comprises a zipper style opening.

4. The heating pouch of claim 1, wherein said insulating layer comprises polyethylene foam.

5. The heating pouch of claim 1, wherein said pouch has a flat bottom edge operable to prevent roll-over.

6. The heating pouch of claim 1, further comprising a fluid-permeable heating compound retainment layer operable to prevent the release of said heating compound when the pouch is open.

7. The heating pouch of claim 1, wherein said exterior layer is integrated into a garment bag.

8. A garment steaming apparatus comprising:
- a garment bag;
- at least one pouch compartment defined on the interior of said garment bag;
- a heating pouch;
- a heating chamber defined in the interior of said heating pouch;
- an exothermic heating compound disposed within said heating chamber;
- an input port on said heating pouch operable to receive fluid into said heating chamber;
- an insulating layer separating said heating chamber from at least one surface on the exterior of said heating pouch;
- an exterior layer of said heating pouch;
- at least one output port operable to release heated vapor from the heating chamber.

9. The garment steaming apparatus of claim 8, wherein said at least one pouch compartment is positioned toward the bottom of said garment bag.

10. The garment steaming apparatus of claim 8, wherein said garment bag is vented at the top to allow steam to escape.

11. The garment steaming apparatus of claim 8, wherein said garment bag contains openings on its exterior to allow the deposit of a heating pouch.

12. The heating pouch of claim 1, further comprising a visible fill line.

13. The heating pouch of claim 1, wherein said insulating layer is flexible.

* * * * *